US006373457B1

(12) United States Patent
Kim et al.

(10) Patent No.: US 6,373,457 B1
(45) Date of Patent: Apr. 16, 2002

(54) DRIVING METHOD FOR LIQUID CRYSTAL DISPLAY AND DRIVING CIRCUIT THEREOF

(75) Inventors: Il-Noung Kim, Kyongg-do; Weung-Sang Lee, Seoul; Byeong-Sang Song, Kyonggi-do, all of (KR)

(73) Assignee: Samsung SDI Co., Ltd., Youngin (KR)

( * ) Notice: Subject to any disclaimer, the term of this patent is extended or adjusted under 35 U.S.C. 154(b) by 0 days.

(21) Appl. No.: 09/305,535

(22) Filed: May 5, 1999

(30) Foreign Application Priority Data

Jul. 1, 1998 (KR) ..... 98-26381

(51) Int. Cl.[7] ..... G09G 3/36
(52) U.S. Cl. ..... 345/95; 345/87; 345/94
(58) Field of Search ..... 345/87, 94, 95, 345/96, 99, 89, 211, 208, 209, 210, 206, 212, 100, 204

(56) References Cited

U.S. PATENT DOCUMENTS 5,296,953 A * 3/1994 Kanbe et al. ..... 359/56
5,594,464 A * 1/1997 Tanaka et al. ..... 345/94
5,608,420 A * 3/1997 Okada ..... 345/89
5,790,092 A * 8/1998 Moriyama ..... 345/96
6,057,817 A * 5/2000 Ono et al. ..... 345/95
6,100,879 A * 8/2000 Da Costa ..... 345/211

* cited by examiner

*Primary Examiner*—Bipin Shalwala
*Assistant Examiner*—Mansour M. Said
(74) *Attorney, Agent, or Firm*—Robert E. Bushnell, Esq.

(57) ABSTRACT

A driving method for a liquid crystal display using liquid crystal having bistable twisted nematic property keeps a first signal and a second signal applied to a liquid crystal cell in one of positive and negative levels, makes an effective voltage applied to the liquid crystal zero, and realizes DC FREE. A driving circuit for a liquid crystal display includes a voltage arrangement that applies the first signal and the second signal, a control signal arrangement that generates a switching control signal and a level-inverting switching control signal, and a multiplexer which selectively switches the first signal and the second signal in accordance with the switching control signal, or inverts and switches the first signal and the second signal in accordance with the level-inverting switching control signal and outputs them to a driving element connected to the liquid crystal cell.

2 Claims, 4 Drawing Sheets

DRIVING METHOD FOR LIQUID CRYSTAL DISPLAY AND DRIVING CIRCUIT THEREOF

BACKGROUND OF THE INVENTION

1. Field of the Invention

The present invention relates to a driving method for a liquid crystal display and a driving circuit thereof, and more particularly, to a driving method for liquid crystal display and a driving circuit thereof using a liquid crystal having bistable twisted nematic property.

2. Description of the Prior Art

Generally, a aligning direction of a liquid crystal inserted between upper substrate and lower substrate of a liquid crystal display is varied by an externally applied field because permittivity of long axis and permittivity of short axis are different, with respect to molecular axis, in terms of material property.

Particularly, a bistable twisted nematic (BTN) liquid crystal is the liquid crystal with cholesteric nematic phase having two metastable status which has 0° and 360° by adding a chiral dopant into a nematic liquid crystal. Such liquid crystal display using the bistable twisted nematic liquid crystal (BTN LCD) is better for realizing high resolution and dynamic picture images than the liquid crystal using nematic liquid crystal since low voltage driving is possible and switching speed also can be increased, and capable of providing wide viewing angle and excellent contrast ratio.

Recently many methods for effective driving of BTN LCD having generally superb characteristics have been disclosed.

In U.S. Pat. No. 5,594,464, a driving method for BTN LCD is disclosed, and a method of applying selection pulse to a liquid crystal cell after applying reset pulse predetermined voltage to the liquid crystal cell for predetermined period is used, as shown in FIG. 4*a*.

A driving method enhancing switching speed of response of liquid crystal is disclosed in Korean patent application No. 98-852 filed by the same applicant of the present invention, and is to apply selection pulse after applying reset pulse for predetermined period while having predetermined idle time before applying selection pulse.

In the two methods, reset pulse and selection pulse applied to the liquid crystal are applied via alternating voltage having zero accumulation value of DC voltage per frame (DC CHARGE) for DC FREE of the liquid crystal.

That is, to apply reset pulse of negative voltage −Vreset, opposite of positive voltage, right before applying reset pulse of positive voltage +Vreset for the same period time, and to apply negative voltage −Vselection, opposite of positive voltage, as selection pulse right before applying positive voltage +Vselection in a frame, which make the effective voltage applied to the liquid crystal in a frame zero.

To apply these four levels, +Vreset, +Vselection, −Vreset, and −Vselection, of voltage to the liquid crystal, conventionally, a method in which the output voltage, scan signal, of common driving element which is a voltage applying mean and output voltage, data signal, of segment driving element are alternated to opposite potential level every certain period is used.

To realize such conventional way of driving method for the liquid crystal display, a driving circuit having multiplexers which switch the four levels of voltage each period and output pulse to a input terminal of the common driving element and segment driving element is used.

The switching speed of multiplexer can be increased if the multiplexer is configured to drive positive voltage rather than negative voltage with regard to the characteristics of a semiconductor device, but in conventional way there is a restriction of increasing driving speed since negative voltage is also needed for driving the liquid crystal.

In addition, since a signal switched by the multiplexer has large voltage margin which is occurred when it is changed from negative level to positive level, there is a problem that a flicker in visual might happen on a display screen.

SUMMARY OF THE INVENTION

The present invention has been made in an effort to solve the above described problems of the prior art.

The objective of the present invention is to apply necessary scan signal and segment signal in one of potential levels and make an effective voltage applied to both ends of actual liquid crystal cell zero within certain frame.

To achieve the above objective, the present invention provides a driving method for a liquid crystal display forming reset pulse and selection pulse applied to a liquid crystal cell by the difference of potential level between a first signal and a second signal which are output from a fist driving element and a second driving element, wherein the driving method is characterized in that though the first signal and the second signal are kept in one of positive and negative potential levels, and applied to the liquid crystal cell, an effective voltage applied to actual liquid crystal cell becomes zero and DC FREE is realized.

In the present invention, the first signal and the second signal are respectively applied in two frames, a first frame and a second frame, though a signal applied in the second frame is formed by inverting waveform of a signal applied in the first frame, but by making a waveform portion of maximum value in the second frame correspond with a waveform portion of minimum value in the first frame, the signal of the first frame constituted from a reset pulse and a selection pulse is inverted to reverse polarity in the second frame and the effective voltage value during these two frames becomes zero.

And the liquid crystal cell adopts bistable twisted nematic liquid crystal in cholesteric nematic group having two metastable status.

It is another objective of the present invention to provide a driving circuit for a liquid crystal display which is to realize above driving method.

The driving circuit which applies the first signal and the second signal to the liquid crystal cell so that a aligning angle of liquid crystal molecules are changed by the field resulting from the difference in potential level between the two signals, comprises:

a voltage applying means for applying the first signal and the second signal, a control signal applying means for generating a switching control signal and a level-inverting switching control signal, and a multiplexer which selectively switches the first signal and the second signal in accordance with the switching control signal, or inverts and switches the first signal and the second signal in accordance with the level-inverting switching control signal and outputs them to a driving element connected to the liquid crystal cell.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF PREFERRED EMBODIMENT

Reference will now be made in detail to the preferred embodiment of the present invention, an example of which is illustrated in the accompanying drawings.

Figure 1:
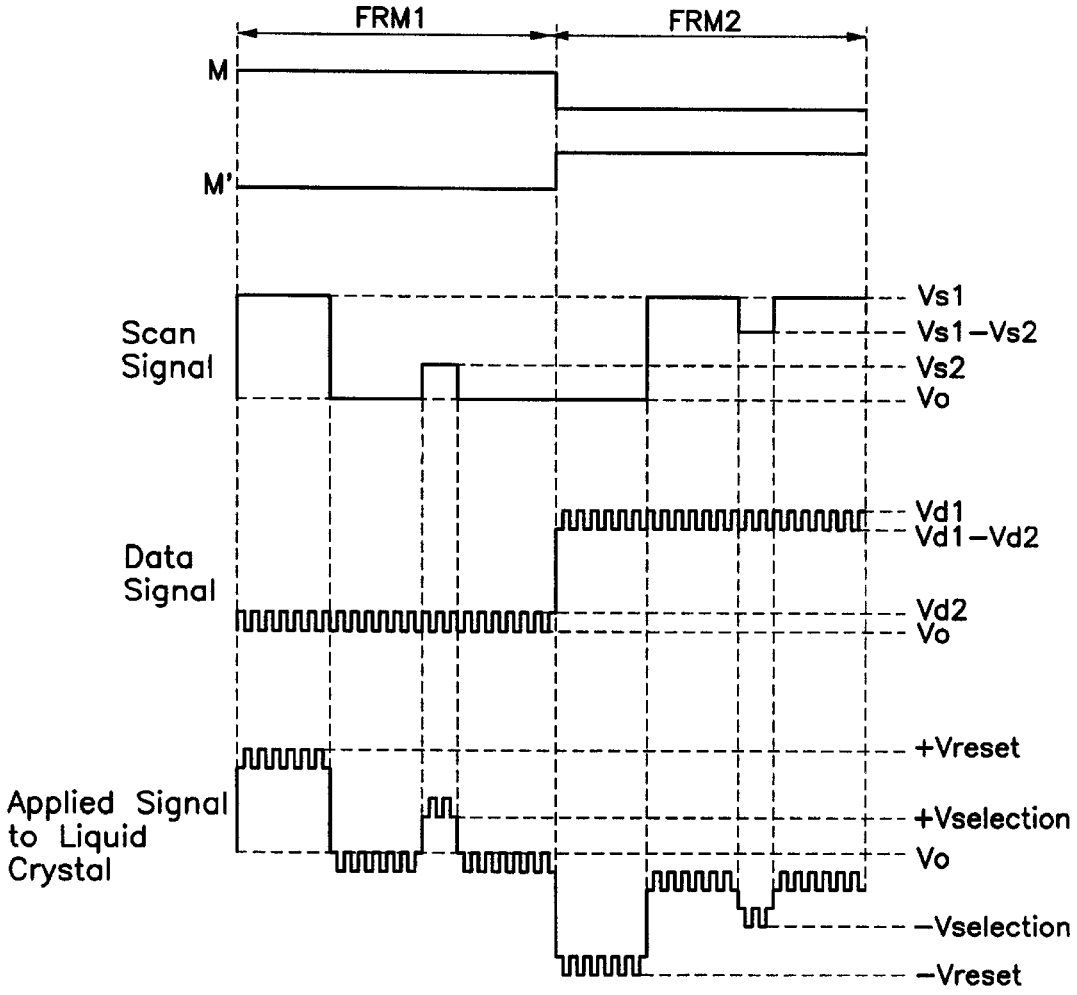
FIG. 1 is a driving pulse waveform chart explaining a driving method according to the present invention.

FIG. 1 is a driving pulse waveform chart for explaining a driving method of the present invention.

A scan signal which is output from a common driving element, a first driving element, and a data signal which is output from a segment driving element, a second driving element, are realized in positive level.

A voltage applied to a liquid crystal cell by this pulse waveform can apply the positive level during a first frame FRM1 and a negative level during a second frame FRM2. Thus, because the effective voltage applied between both ends of the liquid crystal cell during two frames which are the sum of the first frame FRM1, the positive level, and the second frame FRM2, the negative level, becomes zero, DC FREE becomes possible.

As mentioned above, it is possible that the voltage applied to the liquid crystal cell becomes the negative level during the second frame FRM2 while keeping the scan signal and the data signal in the positive level since the voltage applied the liquid crystal cell is made from the combination of the scan signal and the data signal.

To realize DC FREE of the voltage applied between both ends of the liquid crystal cell as described above, the scan signal and the data signal perform inverting waveform of the signal applied during the first frame FRM1 and create a signal which applies during the second frame FRM2.

However by making a portion of maximum value during the second frame FRM2 correspond to a portion of minimum value during the first frame FRM1, the signal of the first frame made of reset pulse and selection pulse applied to the liquid crystal cell is inverted to opposite polarity in the second frame FRM2 so that the effective voltage value during two frames during which the signal is applied to the liquid crystal cell become zero.

The positive level of the first frame FRM1 and the negative level of the second frame are switched while synchronizing with a switching control signal M and a level inverting switching control signal M'.

With respect to the phase of waveform of the scan signal, a portion of waveform formed of highest value Vs1 within the first frame FRM1 corresponds to a portion of waveform formed of lowest value $V_0$ within the second frame FRM2 and the portion of waveform formed of lowest value $V_0$ within the first frame FRM1 corresponds to the portion of waveform formed of highest value Vs1 within the second frame FRM2. In addition, a portion of waveform, a value of which Vs2 is obtained by adding a predetermined value to the lowest value $V_0$ within the first frame FRM1 corresponds to a portion of waveform, a value of which Vs1–Vs2 is obtained by subtracting a predetermined value from the highest value Vs1 within the second frame FRM1.

Regarding the data signal, the lowest value Vo in the first frame FRM1 is the same as the lowest value of the scan signal and the highest value Vd1 in the second frame FRM2 is the same as the highest value of the scan signal, and, with respect to the waveform phase, a portion formed of highest value Vd2 in the first frame FRM1 corresponds to a portion formed of lowest value Vd1–Vd2 in the second frame FRM2.

As described above, the waveform of the voltage applied to both ends of actual liquid crystal cell can be formed in various ways by the combination of the scan signal and the data signal which are output only in the positive level.

Figure 2:
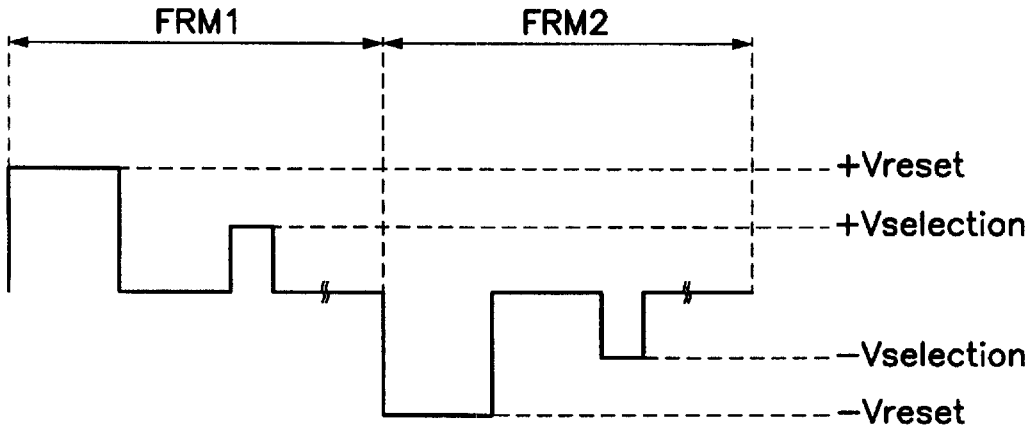
FIG. 2 is a voltage waveform chart applied to a liquid crystal cell according to the present invention.

According to the preferred embodiment of present invention shown in FIG. 1, the voltage, varying level per frame, is applied to the liquid crystal cell as shown in FIG. 2.

Figure 4A:
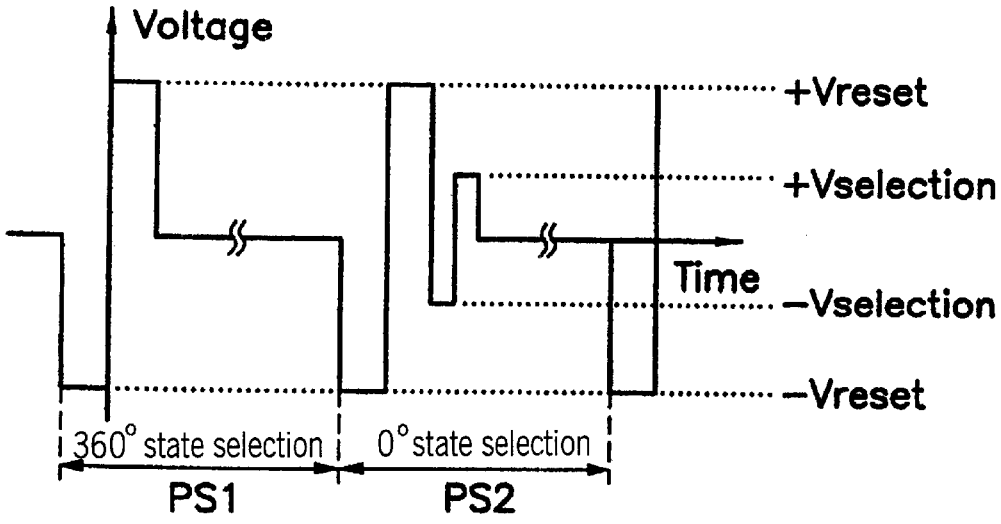
Fig. 4a PRIOR ART
FIGS. 4*a* and 4*b* are waveform charts of a voltage necessary for driving general bistable twisted nematic liquid crystal cell.
Figure 4B:
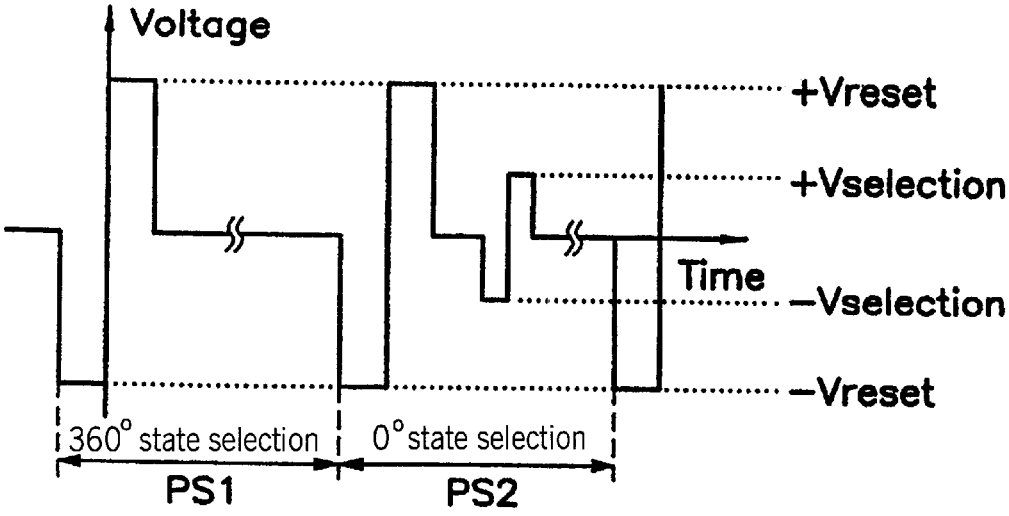
Fig. 4b PRIOR ART

In addition, if switching periods of the switching control signal and the level-inverting switching control signal are shortened, it is easily understood that the voltage applied the liquid crystal cell can be formed as the waveform shown in FIGS. 4*a* and 4*b*, and thus further description and drawings of another embodiment are omitted.

Above-mentioned driving method according to the present invention can be realized by a driving circuit according to the present invention constructed as described below.

Figure 3:
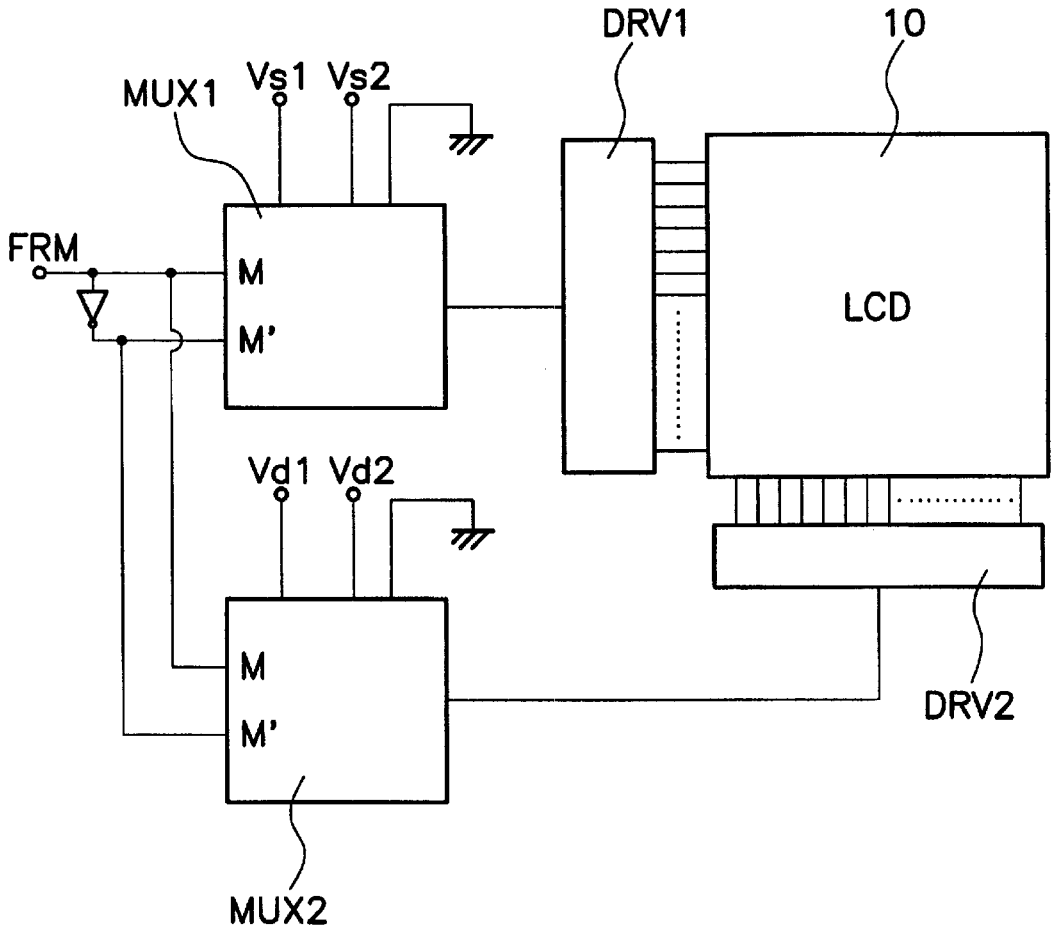
FIG. 3 is a circuit chart showing a driving circuit according to the present invention.

FIG. 3 is a circuit diagram showing the driving circuit according to the present invention.

A common driving element DRV1 and a segment driving element DRV2 are connected to a electrode of a liquid crystal panel 10 formed in matrix-shape. The common driving element DRV1 scans the scan signal in row direction of the liquid crystal panel 10, and the segment driving element DRV2 selectively applies the data signal to the electrode in column side of the liquid crystal panel 10.

The common driving element DRV1 selectively switches the highest value Vs1 and the predetermined value Vs2 of the scan signal voltage in accordance with the switching control signal M, and to be connected to a multiplexer MUX1 for common which inverts the two voltage Vs1 and Vs2, selectively switches, and outputs in accordance with the level inverting switching control signal M'.

The segment driving element DRV2 selectively switches the highest value Vd1 and the predetermined value Vd2 of the data signal voltage depending on the switching control signal M which is applied a frame synchronizing signal FRM, and to be connected to a multiplexer MUX2 for segment which inverts the two voltage Vd1 and Vd2, selectively switches, and outputs depending on the level-inverting switching control signal M' which is obtained by inverting the frame synchronizing signal FRM by an inverter INV.

The driving circuit according to the present invention applies an alternating voltage whose accumulated value of DC voltage DC CHARGE is zero to a scan electrode and a data electrode, not shown, arranged as matrix in the liquid crystal panel 10 by the difference in level between the scan signal and the data signal in the positive level formed from the driving method according to the present invention.

The liquid crystal panel 10 applies the field to the liquid crystal cell located on an intersecting point on the electrode by the alternating voltage applied as mentioned above. In addition, an aligning angle of liquid crystal molecules disposed in the liquid crystal cell varies and displays corresponding pixel.

In the preferred embodiment of the present invention, it is described that the multiplexer MUX1,MUX2 output the signal only in the positive level, but it is also possible that outputting the signal of the multiplexer only in a negative level by fixing the voltage applied to the multiplexer in the negative level.

However, with respect to semiconductor element characteristics, it is advantageous in improving driving speed of the liquid crystal to construct the multiplexer to switch the positive level, since a switching speed of a N-MOS driving element switching the positive level is faster than that of P-MOS driving element switching the negative level.

As described above, the present invention are very effective in many ways since it solves the problem of DC FREE of the voltage applied to the liquid crystal cell and is capable of applying the driving signal of the liquid crystal in either positive or negative level. The various effectiveness are listed hereinafter.

1) The present invention can prevent a flicker phenomenon on the liquid crystal display caused by large voltage margin, occurred in the prior arts, since the margin of signal voltage processed in the driving element decreases.

2) To make the scan signal necessary for driving the liquid crystal, reference voltage level applied to the common driving element is reduced from four levels, used in the prior arts, to two levels. That is, since the two voltage levels applied to the common driving element are used to be applied in four raw levels, it is possible to design the voltage applying mean providing such voltage value smaller.

3) When the driving signal of the liquid crystal is applied in one level, preferably in the positive level, the speed of the driving element becomes faster than that of the prior art, therefore it is applicable to bistable twisted nematic liquid crystal display having high response speed, which in turn makes excellent dynamic picture images in high resolution screen.

4) Since the present invention makes grading up to high speed possible without replacing whole driving circuit portion for realizing high speed but with adding the multiplexer realizing the driving method of the present invention, the common driving element and the segment driving element, passive matrix driving elements, which are currently used can be used as they are, therefore the present invention is very effective in cost reduction.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A driving method for a liquid crystal display, comprising of forming a reset pulse and a selection pulse applied to a liquid crystal cell by the difference of potential level between a first signal and a second signal which are output from a first driving element and a second driving element, respectively wherein the first signal and the second signal having one of positive and negative potential levels is applied to the liquid crystal cell to allow an effective voltage applied to the liquid crystal cell to be zero, thereby realizing DC FREE, wherein the first signal and the second signal are applied in one cycle in a first frame and a second frame;

the first signal is formed so that a waveform portion of the highest value in the first frame corresponds with a waveform portion of the lowest value in the second frame, and a waveform portion of the lowest value in the first frame corresponds with a waveform portion of the highest value in the second frame, and a waveform portion, a value of which is obtained by adding a predetermined value to the lowest value in the first frame corresponds with a waveform portion, a value of which is obtained by subtracting a predetermined value from the highest value in the second frame; and the second signal is formed so that the lowest value in the first frame is the same as the lowest value of the first signal, and the highest value in the second frame is the same as the highest value of the first signal, and a waveform portion of the highest value in the first frame corresponds with a waveform portion of the lowest value in the second frame.

2. A driving method for a liquid crystal display, comprising of forming a reset pulse and a selection pulse applied to a liquid crystal cell by the difference of potential level between a first signal and a second signal which are output from a first driving element and a second driving element, respectively wherein the first signal and the second signal having one of positive and negative potential levels is applied to the liquid crystal cell to allow an effective voltage applied to the liquid crystal cell to be zero, thereby realizing DC FREE, wherein the first signal and the second signal are applied in one cycle in a first frame and a second frame;

the first signal is formed so that a waveform portion of the highest value in the first frame corresponds with a waveform portion of the lowest value in the second frame, and a waveform portion of the lowest value in the first frame corresponds with a waveform portion of the highest value in the second frame, and a waveform portion, a value of which is obtained by adding a predetermined value to the lowest value in the first frame corresponds with a waveform portion, a value of which is obtained by subtracting a predetermined value from the highest value in the second frame; and the second signal is formed so that the lowest value in the first frame is the same as the lowest value of the first signal, and the highest value in the second frame is the same as the highest value of the first signal, and a waveform portion of the highest value in the first frame corresponds with a waveform portion of the lowest value in the second frame, wherein the lowest value in the second frame is obtained by subtracting the difference between the highest value and the lowest value in the first frame from the highest value in the second frame.

* * * * *